US007824156B2

(12) United States Patent
Dellmann et al.

(10) Patent No.: US 7,824,156 B2
(45) Date of Patent: Nov. 2, 2010

(54) COOLED COMPONENT OF A FLUID-FLOW MACHINE, METHOD OF CASTING A COOLED COMPONENT, AND A GAS TURBINE

(75) Inventors: Jürgen Dellmann, Essen (DE); Gernot Lang, Baesweiler (DE)

(73) Assignee: Siemens Aktiengesellschaft, Munich (DE)

( * ) Notice: Subject to any disclaimer, the term of this patent is extended or adjusted under 35 U.S.C. 154(b) by 671 days.

(21) Appl. No.: 11/189,409

(22) Filed: Jul. 26, 2005

(65) Prior Publication Data

US 2007/0014664 A1 Jan. 18, 2007

(30) Foreign Application Priority Data

Jul. 26, 2004 (EP) ..... 04017673

(51) Int. Cl.
*F01D 5/18* (2006.01)

(52) U.S. Cl. ..... 416/96 R

(58) Field of Classification Search ..... 415/97, 415/115; 416/96 R, 97 R
See application file for complete search history.

(56) References Cited

U.S. PATENT DOCUMENTS 2,138,220 A * 11/1938 Trumpler ..... 60/39.43
2,422,193 A * 6/1947 Hague ..... 29/889.21
2,843,354 A * 7/1958 Smith ..... 416/92
4,384,607 A * 5/1983 Wood et al. ..... 164/132
4,684,322 A * 8/1987 Clifford et al. ..... 416/95
5,002,460 A * 3/1991 Lee et al. ..... 416/96 A
5,772,395 A * 6/1998 Schofield ..... 415/90
5,772,397 A * 6/1998 Morris et al. ..... 415/115
5,993,156 A * 11/1999 Bailly et al. ..... 416/96 A
6,132,174 A * 10/2000 Staub et al. ..... 416/96 R
6,382,907 B1 5/2002 Bregman et al.
2004/0096313 A1 5/2004 Harvey et al.
2005/0025623 A1* 2/2005 Botrel et al. ..... 416/97 R
2006/0120868 A1* 6/2006 Dorling et al. ..... 416/97 R

FOREIGN PATENT DOCUMENTS

DE 32 16 960 C2 11/1983
DE 197 38 065 A1 3/1999
WO WO 2004/035992 A1 4/2004

OTHER PUBLICATIONS

"Konstruction", Zeitschrift für Produktentwicklung und Ingenieur-Werkstoffe (Journal for Product Development and Engineering Materials), vol. 55, No. 9, Class of 2003, p. IW 9.

* cited by examiner

*Primary Examiner*—Edward K. Look
*Assistant Examiner*—Nathaniel Wiehe

(57) ABSTRACT

A cooled component of a fluid-flow machine, through which a hot working medium flows, in particular a turbine blade of a gas turbine, in whose outer wall, to which the working medium can be applied, a cooling passage is provided, through which a cooling fluid can flow along its longitudinal axis.

18 Claims, 5 Drawing Sheets

COOLED COMPONENT OF A FLUID-FLOW MACHINE, METHOD OF CASTING A COOLED COMPONENT, AND A GAS TURBINE

CROSS REFERENCE TO RELATED APPLICATIONS

This application claims priority of European application No. 04017673.7 EP filed Jul. 26, 2004, which is incorporated by reference herein in its entirety.

FIELD OF INVENTION

The invention relates to a cooled component of a fluid-flow machine, through which a hot working medium flows, in particular a turbine blade of a gas turbine, in whose outer wall, to which the cooling medium can be applied, a cooling passage is provided, through which a cooling fluid can flow along its longitudinal axis. The invention also relates to a gas turbine having a cooled component and to a method of casting a cooled component.

THE BACKGROUND OF INVENTION

The journal "Konstruktion", Zeitschrift für Produktentwicklung und Ingenieur-Werkstoffe [journal for product development and engineering materials], Volume 55, No. 9, page IW 9, discloses a heat exchanger tube which has ribs running along its longitudinal axis, lying on the inside and twisted about the main flow direction. The ribs serve to enlarge the inner surface of the tube and to produce a swirl in the medium flowing through the tube. This is intended to achieve an increase in the heat transfer compared with a smooth tube.

Furthermore, for example, a turbine blade as a cooled component of a gas turbine is known. The hot working medium produced in a gas turbine by the combustion of a fuel flows along the blades of a rotor in order to produce rotary energy. In order to protect the blades against the hot temperatures, said blades are cooled by means of air or steam. To this end, the blades of the gas turbine have a passage which runs in the interior of the airfoil in the region of a leading edge and extends in the radial direction of the rotor. A cooling fluid flowing in this passage cools the leading edge, which is especially subjected to thermal stress. Such a blade has been disclosed, for example, by DE 197 38 065 A1.

SUMMARY OF INVENTION

An object of the invention is to specify a cooled component for a gas turbine, which component can be cooled in a more efficient manner in order to increase the efficiency. It is also an object of the invention to specify, for this purpose, a gas turbine and a method of casting a cooled component.

The object which relates to the cooled component is achieved by the features of the claims, the object which relates to the gas turbine is achieved by the features of the claims, and the object which relates to the method of casting the component is achieved by the features of the claims. Advantageous configurations are specified in the dependent claims.

To achieve the object which relates to the component, it is proposed that a means which imposes a swirl on the flowing cooling fluid be provided in the cooling passage.

The invention is based on the knowledge that, on account of the heat transfer, the cooling medium heats up steadily and expands at the same time during the flow in the cooling passage. However, this steady increase in volume continuously slows down the flow velocity of the cooling fluid, and downstream sections of the cooling passage therefore exhibit a changed heat transfer relative to upstream sections. In order to compensate for this effect, the cooling fluid is accelerated by imposing a swirl in order thus to compensate for the volume-related deceleration. A uniform heat transfer along the cooling passage can thus be set by imposing a sufficiently large swirl. An increase in the heat transfer is achieved by the swirl in the cooling fluid. Consequently, the component can be cooled more efficiently, a factor which may either be utilized for saving cooling fluid or for greater heat dissipation. In both cases, the cooling effect is increased, which leads either to an improved efficiency through an increased hot-gas temperature or to an improvement in economy due to reduced thermal loading of the component.

A rotary impulse on the cooling fluid can be produced if the means for imposing the swirl is designed as at least one baffle element which is arranged on the inner surface of the cooling passage and extends along a helical line with a helix angle of 45° or greater. Accordingly, a further component is locally imposed in the cooling-fluid flow in the circumferential direction of the cooling passage, this component constituting the swirl about the main flow direction.

In an especially advantageous configuration of the invention, the cooling passage, like a multi-start screw, has a plurality of baffle elements with identical helix angles. This produces a core flow which flows in the center of the cooling passage and from which partial flows directed transversely to the main flow direction branch off continuously. Therefore all the flow-passage segments present between the baffle elements can communicate with one another. The formation of a controlled and effective core flow via the tips of the baffle elements in the longitudinal axis leads to increased performance values with regard to the heat transfer.

The central core flow can form centrally in the interior of the cooling passage if each baffle element projects into the cooling passage to a radial extent which is less than half the diameter of the cooling passage. The cooling passage therefore has no solid core in the center.

The radial extent of each baffle elements is expediently approximately 0.2 times the diameter of the cooling passage.

According to an advantageous proposal, the baffle element projects into the cooling passage to a radial extent which varies along the helical course of the baffle element. The partial flow which flows into the flow-passage segments and which flows transversely to the main flow direction of the cooling fluid can therefore be adapted in accordance with the requirements to the local thermal conditions of the component to be cooled.

A further increase in the heat transfer can be achieved if the cooling passage has at least one turbulator element on its inner surface. An increase in the heat transfer can be achieved in particular if the turbulator element is designed as a rib extending transversely to the helical line of the baffle element, or as aligned or offset sections of a rib, or as studs. The vortices in the cooling fluid which are caused by the turbulator element may likewise be used for locally adapting and increasing the heat transfer.

Especially advantageous is the configuration in which the turbulator elements project into the cooling passage to a radial extent which is less than the radial extent of the baffle elements. The partial flow, forming the swirl, of the cooling fluid is therefore not disturbed to an excessive degree. In this case, the radial extent of each turbulator element is approximately 0.1 times the diameter of the cooling passage.

Adaptation to the local requirements or to the cooling can be achieved if the helix angle of the baffle elements varies along the cooling passage. A partial flow is thus more or less produced transversely to the main flow direction of the cooling fluid. Depending on the design, this permits acceleration or deceleration of the cooling fluid, so that the heat transfer from the outer wall into the cooling fluid can be advantageously influenced in this way.

In an advantageous configuration, the cross section of the means for imposing the swirl is designed like a V thread, like a trapezoidal thread, like a buttress thread or like a round thread.

The cooled component may expediently be a turbine guide blade, a turbine moving blade, a guide ring or a combustion-chamber heat shield.

Especially advantageous is the configuration in which the component is a turbine guide blade or a turbine moving blade, and the cooling passage runs in the region of a leading edge in the blade longitudinal direction.

The turbulators arranged in a turbine moving blade with a cooling passage are provided merely in that region or that part of the cooling-passage circumference which faces the suction-side outer wall. Due to the rotation of the rotor and of the turbine moving blade thus moving with it, secondary flows occur in the cooling fluid flowing in the cooling passage, and these secondary flows induce a varying passage-side heat transfer from the blade material into the cooling fluid along the circumference of the cooling passage. Due to the rotation, a higher streamline density (and thus a higher cooling-fluid pressure) prevails in that region of the circumference of the cooling passage which faces the pressure-side outer wall of the turbine moving blade than in that region which faces the suction-side outer wall, so that, on the passage side, the pressure-side outer wall is cooled more effectively compared with the suction-side outer wall. However, the suction-side outer wall of a turbine blade, on account of the flow of hot gas around it, is subjected to higher temperatures than the pressure-side outer wall. It is therefore desirable to cool the suction-side outer wall to a different degree compared with the pressure-side outer wall. This is taken into account by the turbulators being arranged merely in that region of the circumference of the passage which faces the suction-side outer wall. As a result, a greater passage-side heat transfer than hitherto can be achieved at this location.

Furthermore, the invention, for producing a component in a casting process with a casting mold, proposes that the means for imposing a swirl be produced during the casting by the corresponding baffle-element structure and/or the turbulator-element structure being incorporated in a casting core, to be inserted for forming a cooling passage in a casting mold, before the insertion.

BRIEF DESCRIPTION OF THE DRAWINGS

The invention is explained with reference to a drawing, in which.

DETAILED DESCRIPTION OF INVENTION

Figure 6:
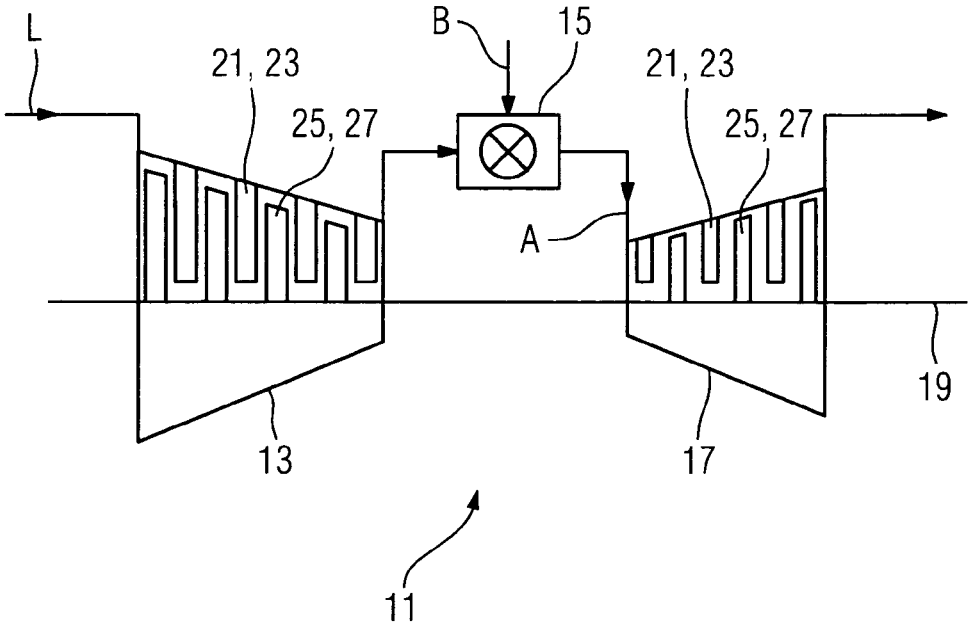
FIG. 6 shows a gas turbine according to the invention.

Gas turbines and their modes of operation are generally known. FIG. 6 shows a gas turbine 11 with a compressor 13, a combustion chamber 15 and a turbine unit 17, which follow one another along a rotor 19 of the gas turbine 11. A driven machine, e.g. a generator (not shown), is coupled to the rotor 19 of the gas turbine 11.

In both the compressor 13 and the turbine unit 17, guide blades 23 and moving blades 27 are provided in such a way as to follow one another in each case in blade rings 21, 25.

During operation of the gas turbine 11, air L is drawn in and compressed by the compressor 13. The compressed air is then fed to the combustion chamber 15 and is burned with the admixing of a fuel B to form a hot working medium A. The hot working medium A expands in the turbine unit 17 to perform work at the moving blades 27, which drive the rotor 19, and the latter drives the compressor and the driven machine (not shown).

Figure 1:
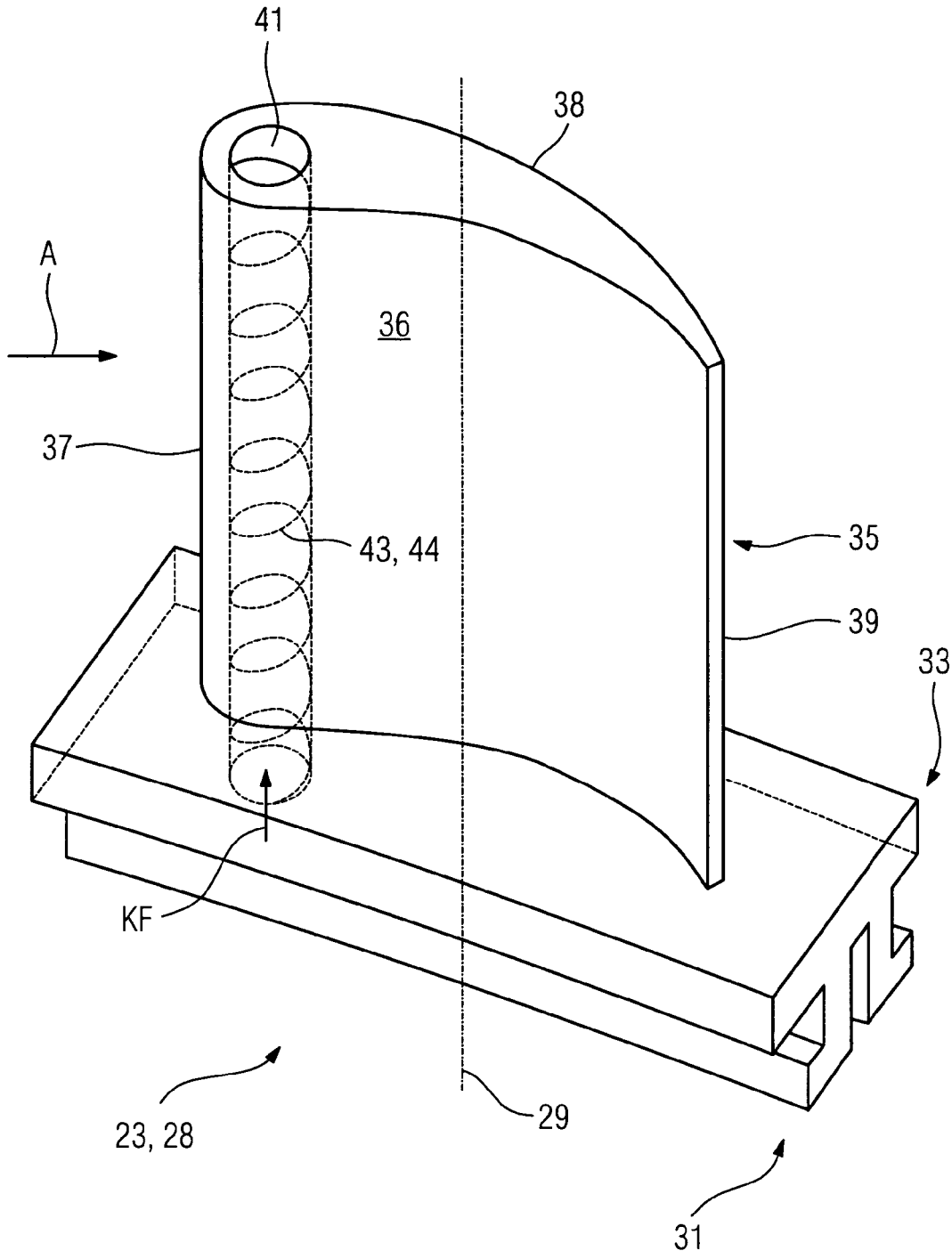
FIG. 1 shows a turbine blade with a cooling passage in the region of a leading edge.

In this case, the guide blades 23 and moving blades 27 of the turbine unit 17 are cooled with a cooling fluid KF, for example air or steam, so that they can withstand the temperatures prevailing there of the hot working medium A. Such a guide blade 23 is shown as cooled component 28 in FIG. 1. The guide blade 23 has a blade root 31, a platform region 33 and an airfoil 35 following one another along the blade axis 29. The airfoil 35 extends with a pressure-side outer wall 36 and a suction-side outer wall 38 from a leading edge 37 to a trailing edge 39. Arranged in the region of the leading edge 37 is a cooling passage 41 which runs parallel to the blade axis 29 and on the inner surface of which a baffle element 43, which projects into the cooling passage 41, is arranged.

Figure 2:
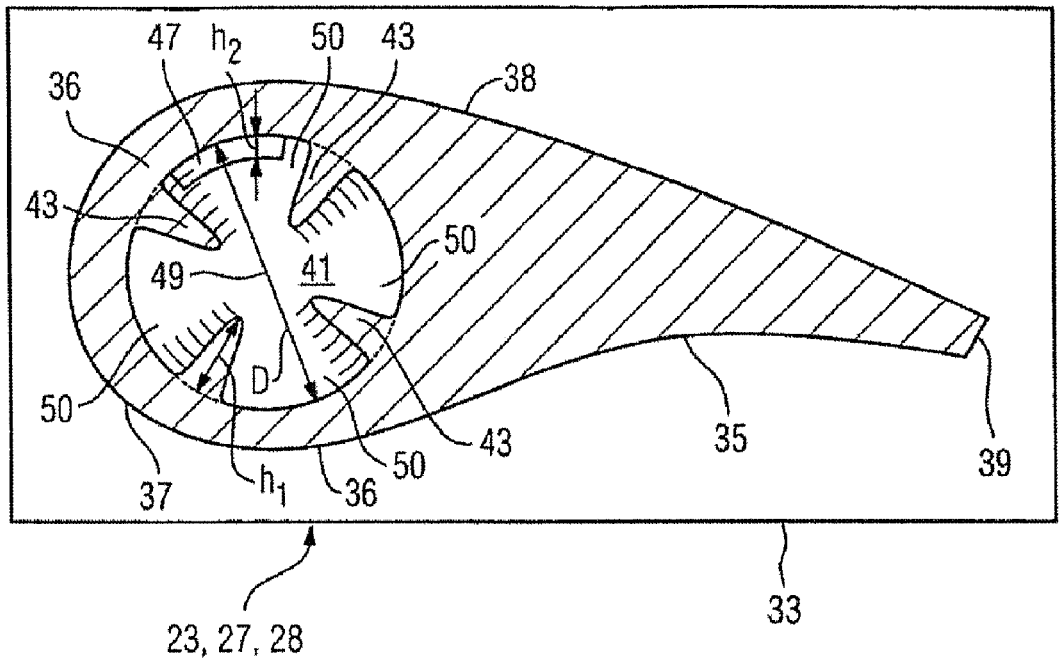
FIG. 2 shows a section through the airfoil of a turbine blade with a cooling passage.

FIG. 2 shows a section through the airfoil 35 of a turbine blade, which may be designed as a guide blade 23 or as a moving blade 27. The cooling passage 41 is arranged with a diameter D in the region of the leading edge 37, and four baffle elements 43 project like a four-start screw into said cooling passage 41. The diameter D is described by a boundary of the cooling-passage cross section which can be divided into sections and belongs to a circle having the same area as the cooling-passage cross section.

In cross section, the baffle elements 43 taper in the direction of a center 49 of the cooling passage 41 in a similar manner to a buttress thread. Alternatively, the cross section of the baffle elements could also be trapezoidal or triangular.

Figure 3:
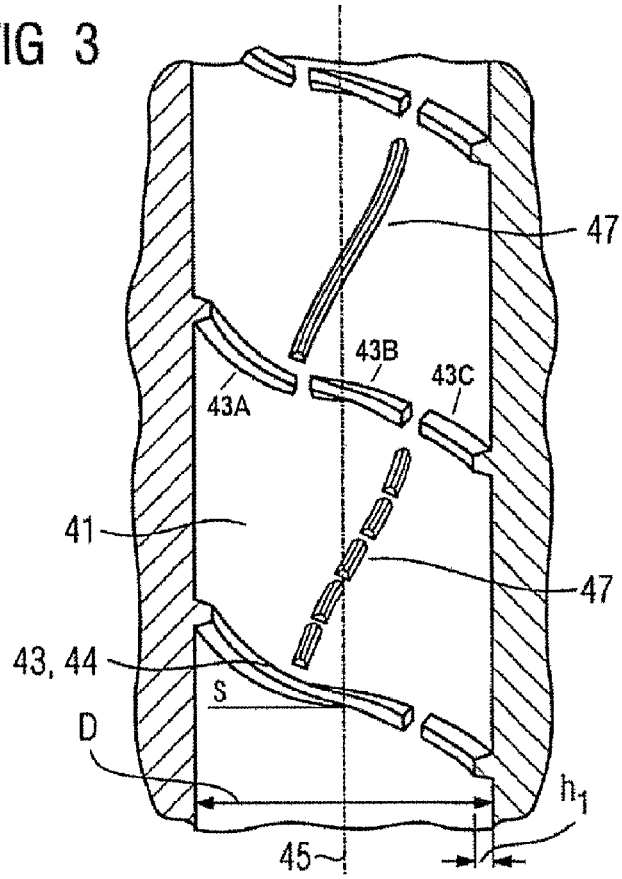
FIG. 3 shows a cooling passage for a cooled component with baffle and turbulator elements.

FIG. 3 shows the cooling passage 41 with a baffle element 43 lying on a helical line 44. In this case, the main flow direction of the cooling fluid KF runs along a longitudinal axis 45 of the cooling passage 41. Relative to each end disposed perpendicularly to the longitudinal axis 45, the helical line 44 of the baffle element 43 has a helix angle S of 45° or greater. Furthermore, the baffle element 43 projects with a radial extent $h_1$ into the cooling passage 41 of circular cross section, the order of magnitude of this radial extent $h_1$ being 0.2 times the diameter D. Furthermore, FIG. 3 shows rib- or stud-shaped turbulator elements 47 which run transversely to the helical line 44 of the baffle elements 43 and whose radial extent $h_2$ is less than that of the baffle elements 43, in particular in the order of magnitude of 0.1 times the diameter D.

During operation of the gas turbine 11, the working medium A flows around the airfoil 35 of the turbine blade. To cool the outer wall 36, 38, which is especially subjected to thermal stress, the cooling fluid KF, for example compressor air, flows through the cooling passage 41 in the direction of the longitudinal axis 45. A flow component directed transversely to the main flow direction, in particular in the circumferential direction, is imposed on the cooling fluid KF by the baffle elements 43. This produces a swirled core flow which flows in the center 49 and rotates about the longitudinal axis 45 of the cooling passage 41. The rotary impulse thus exerted on the cooling fluid KF causes the core flow to flow to the outer margin of the cooling passage 41 into the pocket-shaped flow-passage segments 50. The better intermixing of the cooling fluid achieved in this way leads on the one hand to the cooling effect being made more uniform and on the other hand to an increase in the heat transfer from the outer wall into the cooling fluid KF. The leading edge 37 of the turbine blade is therefore cooled in a more efficient manner.

The arrangement shown proves to be especially advantageous when used in moving blades 27, since the moving blade 27 rotates with the rotor 19 and thus the cooling fluid KF is exposed to a centrifugal force effect. The rib-shaped baffle elements 43 twisting like a screw produce the swirl-like movement, directed transversely to the main flow direction, of the cooling fluid KF, so that the partial flows, also referred to as secondary flows, achieve an increase in the effectiveness of the heat transfer. As a result, cooling air can be saved for increasing the efficiency of the gas turbine 11. Instead of a reduction in the cooling-air flow rate, the locally improved heat transfer and the increased heat dissipation by the cooling fluid can permit an increase in the temperature of the hot working medium A, a factor that likewise leads to an increase in the efficiency of the gas turbine 11.

Figure 7:
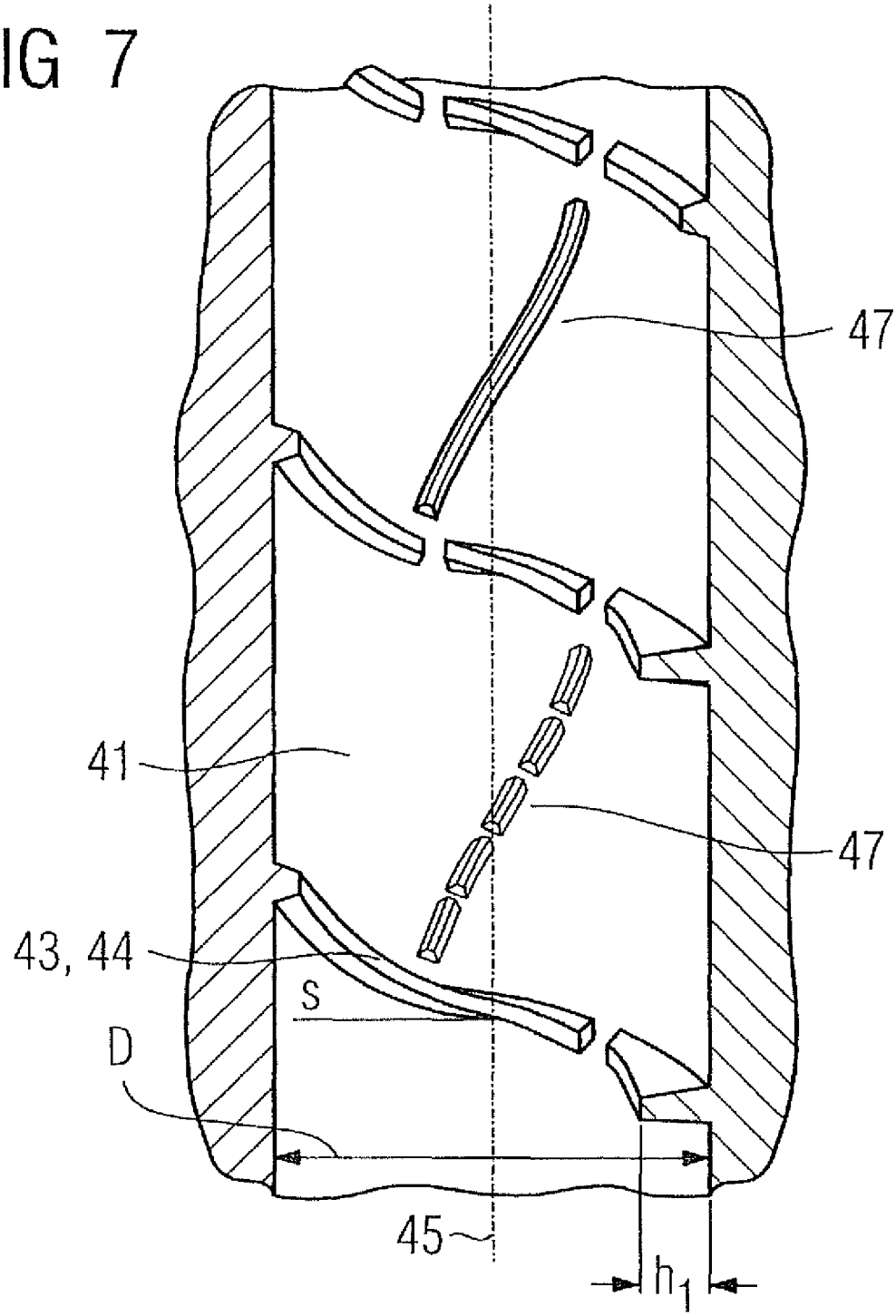
FIG. 7 shows a cooling passage for a cooled component with baffle and turbulator elements, specifically showing that the radial extent varies along the helical path.

The radial extent h.sub.1 of the baffle elements 43 may in this case run in an increasing or decreasing manner over the circumference and/or length of the cooling passage 41 (see FIG. 7), so that a transversely directed partial flow of varying magnitude can be achieved. See, for example, the spaced-apart segments 43A, 43B and 43C of the baffle element 43 as shown in FIG. 3. Generally, each baffle element 43 may comprise a plurality of spaced-apart segments The turbulator elements 47 are to be arranged in the flow-passage sectors 50 at those sections of the circumference of the cooling passage 41 of the moving blades 27 which, in the direction of rotation of the rotor 19, are to be designated as a leading part of the circumference of the cooling passage 41 with locally lower pressure in the cooling-fluid flow, i.e. the turbulator elements 47 are arranged on that side of the cooling passage 41 which faces the suction-side outer wall 38 (see FIG. 2).

With increase in the swirl, the magnitude of the volumetric flow of the cooling fluid becomes smaller; at the same time, the cooling-fluid flow rate and the local turbulence stimulating the heat transfer increase. The turbulent stimulation of the cooling effect is assisted locally by the flow guidance in the region of the rib structure via the specifically placed turbulator elements 47 on the passage side leading in the rotating system, so that the adverse remote effect of the centrifugal-force field on the heat transfer of the cooling-fluid flow is reduced and local temperature gradients are evened out and the low-cycle fatigue behavior is improved.

Figure 4:
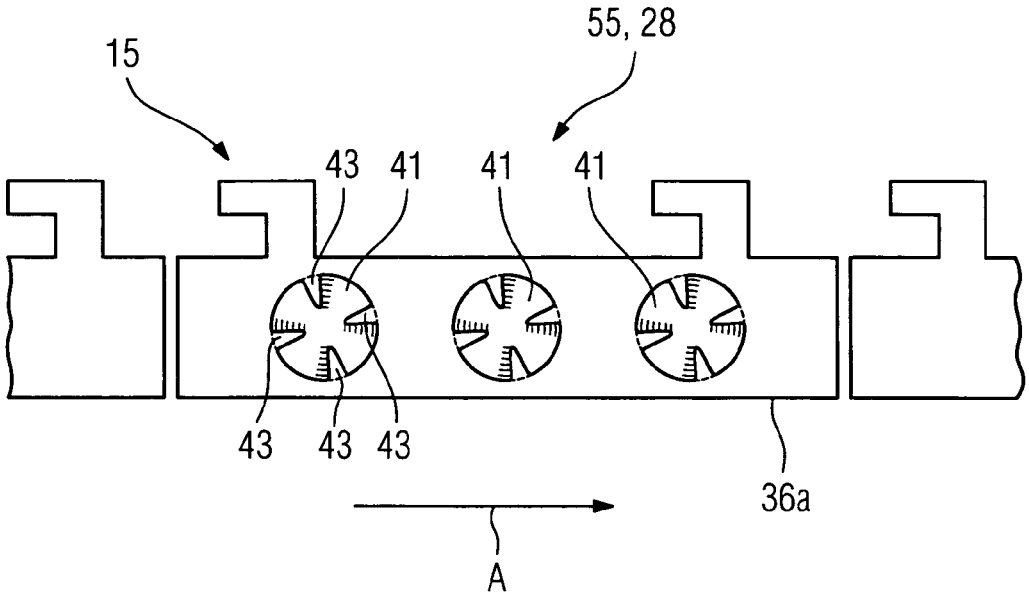
FIG. 4 shows a combustion-chamber heat shield with a cooling passage for the combustion chamber of a gas turbine.

FIG. 4 shows a combustion-chamber heat shield 55 as a cooled component 28 of a gas turbine. The combustion-chamber heat shield 55 has an outer wall 36*a* to which a hot working medium can be applied and in which a plurality of cooling passages 41 are provided for cooling said outer wall 36*a*. To produce a rotary impulse in the cooling fluid KF flowing through the cooling passages 41, the passages 41 are each formed with four baffle elements 43 like a four-start screw.

Figure 5:
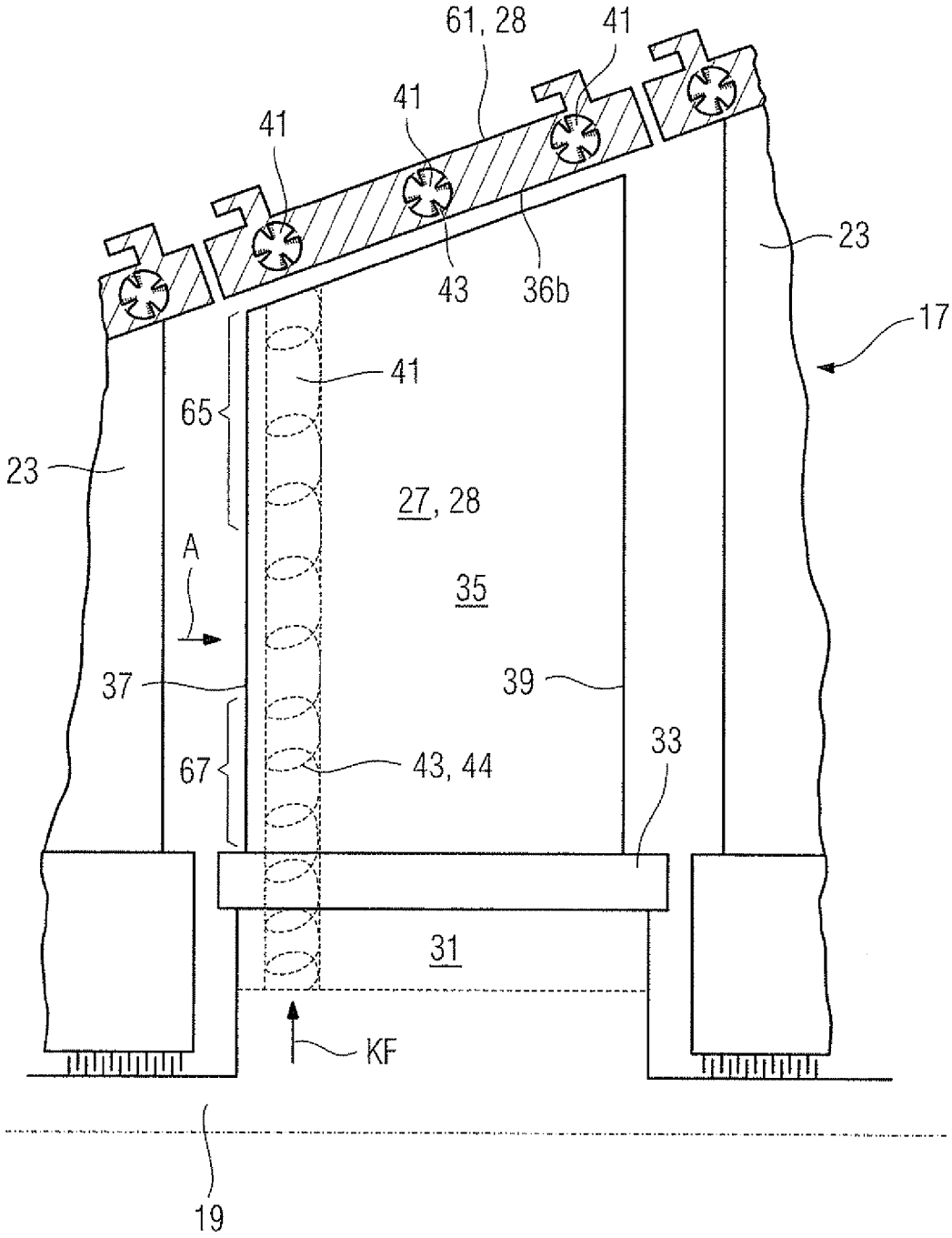
FIG. 5 shows a guide ring with a cooling passage for the flow passage of a gas turbine.

FIG. 5 shows the rotor 19 of a gas turbine 11 with a moving blade 27 fastened thereto. A guide blade 23 is in each case arranged adjacent to the moving blade 27 in the direction of flow of the working medium A. At the radially outer end of the airfoil 35, a guide ring 61 is arranged opposite the airfoil tip. The guide ring 61 defines the flow passage of the turbine unit 17 radially on the outside. A plurality of cooling passages 41 in which the cooling fluid KF can flow are arranged for cooling the outer wall 36*b* of the guide ring 61, a plurality of baffle elements 43 imposing a rotary impulse or a swirl on the cooling fluid KF.

Turbulators 47 can likewise be used in those regions of the cooling-passage circumference of combustion-chamber heat shields 55 and/or guide rings 61 which are the nearest regions opposite the outer wall to which hot gas is applied.

In FIG. 5, in a similar manner to FIG. 2, the cooling passage 41, in which the baffle element 43 imposes a swirl on the cooling fluid KF, is arranged in the moving blade 27 in the region of the leading edge 37. In that region 65 of the cooling passage 43 which lies radially further on the outside, the helix angle S of the helical line 44 is increased compared with the radially inner region 67, a factor which leads to acceleration of the cooling fluid KF. The flow velocity of the cooling fluid KF and the heat transfer can therefore be specifically influenced.

It is known that the cooled component 28, in particular a moving blade 27, is produced by a casting process. In this case, the means for imposing a swirl, i.e. the baffle elements 43 and if need be the turbulator elements, are already advantageously taken into account during the casting by virtue of the fact that the corresponding baffle-element structure and/or the turbulator-element structure is incorporated in a casting core, to be inserted for forming a cooling passage in a casting mold, before the insertion.

It is likewise conceivable to produce the rib-shaped baffle elements 43 in solid blades by a suitable etching process or by means of a two-stage process as in the tapping process.

The invention claimed is:

1. A cooled component of a fluid-flow machine, comprising:

an outer wall adapted to be contacted by hot working medium;

a cooling passage, having a center region extending along a longidudinal axis of the component, through which a cooling fluid can flow along the longitudinal axis; and a baffle element comprising a plurality of spaced-apart segments arranged to form a spiral pattern along an inner surface of the cooling passage, the baffle element extending along a helical path with a helix angle of 45° or greater, neither the cooling passage or the baffle element having a solid core in the center region of the cooling passage, wherein the baffle element extends from the inner surface toward the center region a radial extent in a manner according to which a partial flow, transversely directed with respect to the longitudinal axis, and of varying magnitude, can be achieved along the helical path of the baffle element.

2. The component as claimed in claim 1, wherein at least part of the hot working medium contacts the outer wall.

3. The component as claimed in claim 1, wherein the cooling passage has a plurality of baffle elements with identical helical angles.

4. The component as claimed in claim 1, wherein the baffle element projects into the cooling passage to a radial extent less than half a diameter of the cooling passage.

5. The component as claimed in claim 4, wherein the radial extent is approximately 0.2times the diameter, D, of the cooling passage.

6. The component as claimed in claim 1, wherein the cooling passage has a turbulator element along the inner surface.

7. The component as claimed in claim 6, wherein the turbulator element is a rib extending transversely to the helical path of the baffle element.

8. The component as claimed in claim 7, wherein the turbulator element extends perpendicularly to the helical path of the baffle element.

9. The component as claimed in claim 6, wherein the turbulator element projects into the cooling passage with a turbulator radial extent that is less than a radial extent of the baffle elements.

10. The component as claimed in claim 9, wherein the turbulator radial extent is approximately 0.1 times a diameter of the cooling passage.

11. The component as claimed in claim 6, wherein the turbulators arranged in the cooling passage are in a region of a cooling passage circumference that faces a suction-side outer wall.

12. The component as claimed in claim 1, wherein the helical angle varies along the cooling passage.

13. The component as claimed in claim 1, wherein a cross section of the baffle is a thread selected from the group consisting of a V thread, a trapezoidal thread, a buttress thread and a round thread.

14. The component as claimed in claim 1, wherein the component is selected from the group consisting of a turbine guide blade, a turbine moving blade, a guide ring and a combustion chamber heat shield.

15. The component as claimed in claim 14, wherein the cooling passage extends in the region of a leading edge in a blade longitudinal direction if the component is the turbine guide blade or the turbine moving blade.

16. A gas turbine through which a hot working medium flows and having a cooled component, comprising:

a compressor section;

a combustion chamber; and a turbine section, the turbine section having a cooled component, the cooled component comprising:

an outer wall adapted for contact with the hot working medium, a cooling passage through which a cooling fluid can flow, and a baffle element comprising a plurality of spaced-apart segments arranged to form a spiral pattern along an inner surface of the cooling passage and extending along a helical path with a helical angle of 45° or greater, wherein the baffle element projects into the cooling passage to a radial extent that is less than half the diameter, D, of the cooling passage, wherein the radial extent varies along the helical path of the baffle element, neither the cooling passage or the baffle element having a solid core in the center region of the passage.

17. The turbine as claimed in claim 16, further comprising a turbulator element along an inner surface of the cooling passage, the turbulator element having a turbulator radial extend that is less than the radial extent of the baffle element.

18. A method of casting a component, comprising:

providing a casting mold with a casting core that can be inserted for forming a cooling passage;

incorporating a baffle element, comprising a plurality of spaced-apart segments arranged to form a spiral pattern, along an inner surface of the cooling passage, the baffle extending along a helical path with a helical angle of 45° or greater and having a baffle extending into the passage a radial extent less than half of the diameter, D, of the cooling passage, wherein the radial extent varies along a helical course of the baffle element, neither the cooling passage or the baffle element having a solid core in the center region of the cooling passage; and incorporating a turbulator element along the inner surface of the cooling passage, the turbulator element extending transversely to the helical path of the baffle element, the turbulator element having a turbulator radial extent less than that of the baffle radial extent.

* * * * *